US005090022A

United States Patent [19]

Mortimer

[11] Patent Number: 5,090,022

[45] Date of Patent: Feb. 18, 1992

[54] COLD CRUCIBLE INDUCTION FURNACE

[75] Inventor: John H. Mortimer, Medford, N.J.

[73] Assignee: Inductotherm Corp., Rancocas, N.J.

[21] Appl. No.: 526,344

[22] Filed: May 21, 1990

[51] Int. Cl.[5] ..... H05B 6/22

[52] U.S. Cl. ..... 373/156; 373/151; 373/152; 373/154; 373/158; 373/144; 75/10.15

[58] Field of Search ..... 373/156, 144, 151, 152, 373/153, 154, 158; 75/10.15

[56] References Cited

U.S. PATENT DOCUMENTS

| | | | |
|---|---|---|---|
| 1,824,618 | 9/1931 | Northrup | 373/158 |
| 1,834,725 | 12/1931 | Northrup | 373/152 |
| 1,839,801 | 1/1932 | Northrup | 373/152 |
| 1,879,360 | 9/1932 | Linnhoff | 373/151 |
| 1,943,802 | 1/1934 | Northrup | 373/146 |
| 3,314,670 | 4/1967 | Kennedy | 373/152 |
| 3,461,215 | 8/1969 | Reboux | 373/158 |
| 3,775,091 | 11/1973 | Clites et al. | 75/65 |
| 4,058,668 | 11/1977 | Clites | 13/32 |
| 4,432,093 | 2/1984 | Reboux | 373/144 |
| 4,738,713 | 4/1988 | Stickle et al. | 75/10.18 |
| 4,873,698 | 10/1989 | Boen | 373/158 |

OTHER PUBLICATIONS

P. G. Clites, "The Inductoslag Melting Process," U.S. Department of the Interior Bulletin 673, 1982.

*Primary Examiner*—Bruce A. Reynolds
*Assistant Examiner*—Tu Hoang
*Attorney, Agent, or Firm*—Seidel, Gonda, Lavorgna & Monaco

[57] ABSTRACT

A coreless induction furnace comprising a crucible for holding a quantity of metal to be heated by the furnace. The crucible has an open top, side walls and a closed bottom. An induction coil is operatively associated with the crucible for generating a time-varying magnetic induction field. Coupling structure extending above the top of the crucible is provided to couple at least a portion of the induction field to the center portion of the top surface of the metal to be heated.

20 Claims, 2 Drawing Sheets

FIG. 1
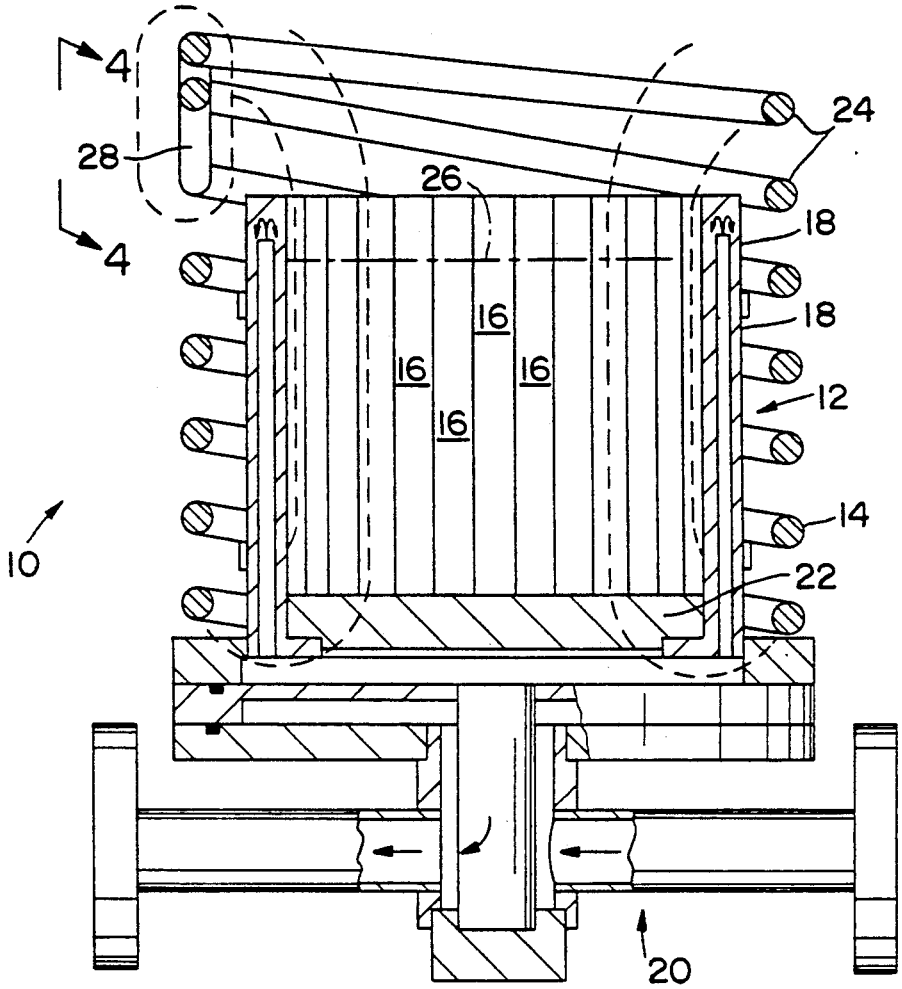
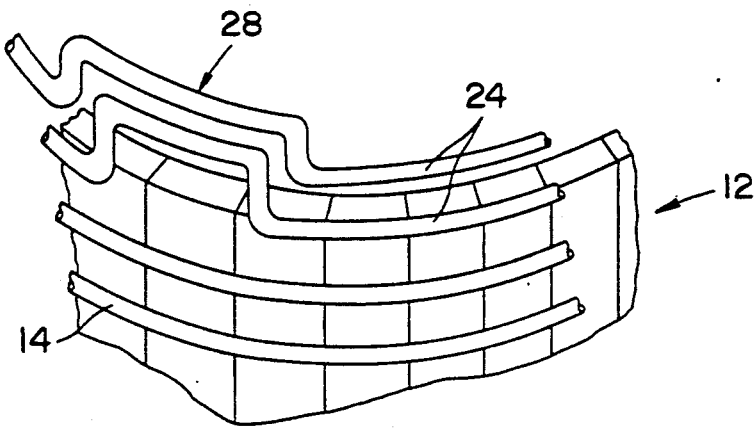
FIG. 2

FIG. 3
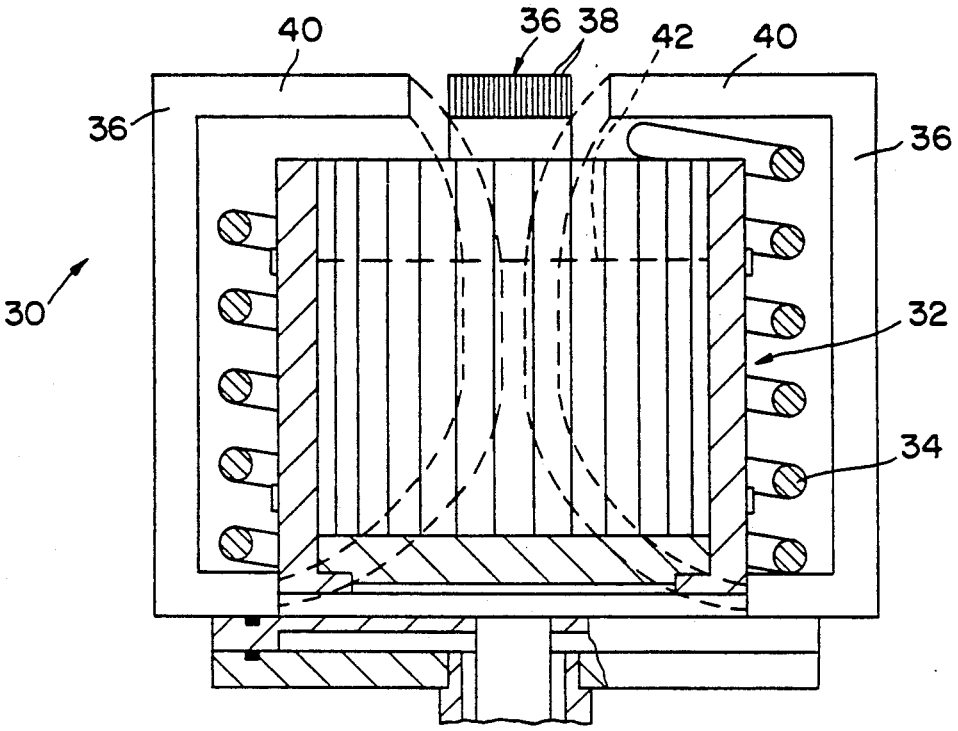
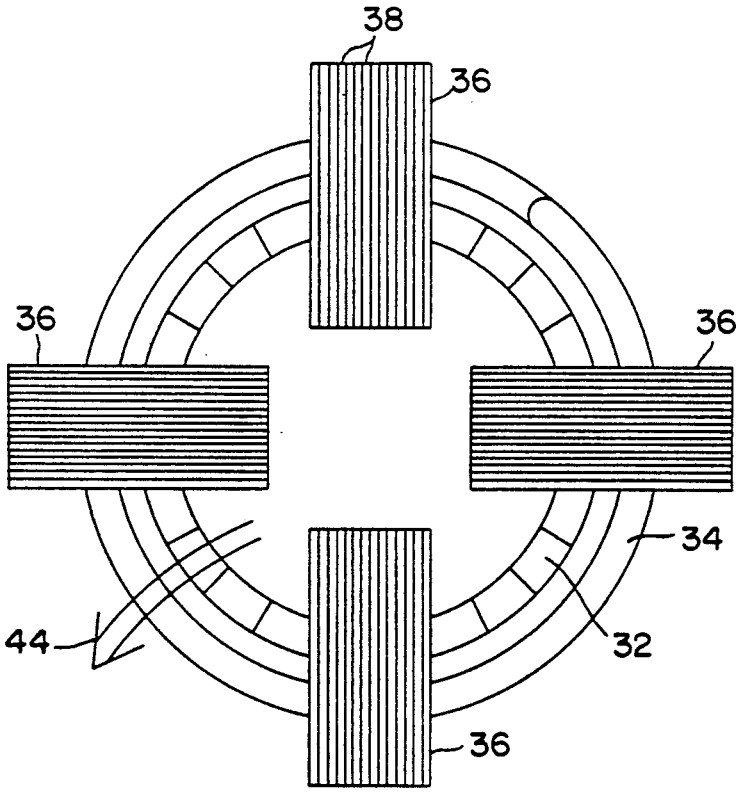
FIG. 4

COLD CRUCIBLE INDUCTION FURNACE

FIELD OF THE INVENTION

The present invention relates to cold-crucible induction heating of metals. In particular, the present invention relates to a cold crucible with improved flux coupling between the induction coil and the metal in the crucible.

BACKGROUND OF THE INVENTION

Cold crucible induction melting is widely used for melting and forming reactive metals having high melting points, such as titanium, zirconium and the like. In most induction melting processes, a crucible of a refractory material, such as aluminum oxide, is used to contain the metallic charge. However, high melting point and reactive metals, such as titanium, zirconium, hafnium, molybdenum, chromium, niobium and other metals and alloys of that type cannot be melted successfully in refractory crucibles. When molten, such metals react with and dissolve refractory crucibles, causing the melt to become contaminated.

The solution to the contamination problem has been to cool the crucible to avoid temperatures high enough for reactions to occur between the crucible and the contained metal. This solution relies on crucibles made usually of copper and cooled by circulating water through cooling passages inside the crucible walls and bottom. So-called "cold crucibles" are typically constructed from metals having high thermal conductivity, such as copper, and are cooled, typically by circulating water, in order to hold the temperature of the crucible below temperatures at which reactions between the crucible and the metal being melted would occur. Cold crucibles of this type are disclosed in U. S. Pat. Nos. 3,775,091, 4,058,668 and 4,738,713, and in United States Department of the Interior Bulletin 673, entitled "The Inductoslag Melting Process," by P. G. Clites (1982).

Without exception, the induction coils used with the cold crucibles known in the art do not extend past the top of the crucible. That is, the entire coil is below the plane defined by the top of the crucible. The primary reason for this is to enable the metal in the crucible to be poured out into molds for casting. At the end of the melt cycle, the crucible is tilted and the metal is poured into one or more molds. The induction coil is tilted with the crucible, and the coil is kept below the top of the crucible so that metal will not contact the coil during pouring.

The problem with cold crucible induction furnaces of this type is that very little of the induction field generated by the induction coil is able to get through the crucible walls to the metal inside the crucible. This means that the cold-crucible induction melting process is very inefficient.

It is an object of the present invention to provide a cold-crucible induction furnace with improved coupling of the induction field from the induction coil to the metal contained in the crucible and therefore improve significantly the efficiency of the cold-crucible induction melting process. However, it should be understood that the present invention, while especially effective in improving the efficiency of the cold-crucible induction melting process is not limited to that process, and can be used in all types of induction melting and heating where increased efficiencies are desired.

SUMMARY OF THE INVENTION

The present invention is directed to a coreless induction furnace comprising a crucible for holding a quantity of metal to be heated by the furnace. The crucible has an open top, side walls and a closed bottom. An induction coil is operatively associated with the crucible for generating a time-varying magnetic induction field. Coupling means extending above the top of the crucible are provided to couple at least a portion of the induction field to the center portion of the top surface of the metal to be heated.

In one embodiment of the invention, the coupling means is realized by the induction coil having at least one coil turn above the top of the crucible. In another embodiment of the invention, the coupling means is realized by magnetic shunt means operatively associated with the induction coil and having a portion extending above the top of the crucible.

In the preferred embodiments of the invention, the crucible has means for permitting a cooling fluid to circulate through it. However, it will be understood that the invention is not limited to a crucible with cooling means.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is a simplified diagram of a cold-crucible induction furnace according to one embodiment of the invention, seen in transverse cross-section.

FIG. 2 is an enlarged view of a portion of the induction furnace of FIG. 1, taken along the lines 4—4 in FIG. 1.

FIG. 3 is a simplified diagram of an induction furnace according to a second embodiment of the invention, seen in transverse cross-section.

FIG. 4 is a top plan view of the furnace shown in FIG. 3.

DESCRIPTION OF THE INVENTION

Referring now to the figures, wherein like numerals indicate like elements, there is shown in FIG. 1 a cold-crucible induction furnace, indicated generally by reference numeral 10, according to one embodiment of the invention. Furnace 10 comprises a cold crucible 12 surrounded by an induction coil 14. Crucible 12 may be any type of cold crucible known in the art, such as those shown in U.S. Pat. Nos. 4,058,668 and 4,738,713. The exact structure of crucible 12 is not critical to the present invention.

Briefly, crucible 12 has a cylindrical side wall made up of a plurality of individual segments 16 tightly bound together to form a substantially continuous side wall. Each segment has cooling passages 18 therein which permit a cooling fluid, such as water, to flow through the segments and cool them as required. Cooling passages 18 are connected to a cooling manifold 20 which supplies fresh coolant to passages 18 and removes exhausted coolant, as indicated generally by the arrows in FIG. 1. Crucible 12 has an open top and a closed bottom 22. Bottom 22 may also, but need not, be cooled by the cooling fluid supplied by manifold 20.

Coil 14 is a conventional induction coil which generates a time-varying induction field when excited by an alternating current. Coil 14 induces eddy currents in the metal charge contained in crucible 12 in known manner, which results in induction heating and melting of the charge. However, in order to achieve this result, it is necessary that the field couple with the metal charge. To enable the field to do so efficiently, coil 14 is provided with coupling means in the form of a least one additional coil turn which extends above the top of crucible 12. In the drawings, two such additional turns 24 are illustrated. As indicated by the dashed lines in FIG. 1, which represent flux lines of the induction field, the additional coil turns 24 couple a portion of the field to the center portion of the top surface 26 of the metal (shown in phantom in FIG. 1) contained in crucible 12. The additional coil turns enable the flux lines of the induction field to bypass the side wall of the crucible and couple directly to the metal charge instead of partially coupling to the side wall. This means that more energy from the induction field is coupled to the charge, increasing the efficiency of the cold-crucible process. As an additional benefit, less energy from the induction field is coupled to the side wall of the crucible, which means that fewer heat-generating eddy currents are induced in the crucible. This is turn minimizes heat loading on the crucible cooling system, further enhancing the overall efficiency of the process.

The furnace 10 may be tapped by tilting it to pour the molten charge into one or more casting molds, or other receptacles, in conventional fashion. To avoid contamination of the melt by additional coil turns 24 when pouring, and to avoid damage to the additional turns by molten metal, the additional turns 24 are formed to define a pour opening, or "eyebrow," 28 through which the melt can pass when pouring without contacting the additional turns. Opening 28 can be obtained by bending or otherwise forming additional turns 24 so that they leave an opening sufficiently large to permit the melt to be easily poured without coming into contact with the turns. The small degree of deformity "eyebrow" 28 imposes on the additional turns has little, if any, measurable effect on the improved performance of furnace 10.

A second embodiment of a furnace according to the invention is illustrated in FIGS. 3 and 4. In those figures, furnace 30 comprises a crucible 32 which is identical to crucible 12 except that the cooling passages have been omitted. Although the present invention is especially well-suited for cold-crucible induction melting, it is not limited to that process, and may be used whenever increased efficiencies in induction melting are desired. Furnace 30 also comprises an induction coil 34, which may be a conventional induction heating coil. Coil 34 is identical to coil 14, except that it does not have additional turns extending above the top of crucible 32. Instead of using additional coil turns to couple the induction field from coil 34 to the center of the top surface of the melt, this embodiment of the invention uses laminated magnetic shunts 36 located in quadrature around the outer circumference of crucible 32. Although four shunts are illustrated, it should be understood that the precise number of shunts and their precise physical locations around crucible 32 is not critical to the invention. Thus, a greater or lesser number of shunts may be used, and they need not be located at precise angular positions around crucible 32.

Each shunt 36 is constructed with a plurality of laminations 38, in the manner of a conventional laminated transformer core. This construction enables the shunts 36 to conduct a portion of the magnetic field generated by coil 34 to the metal in the furnace while limiting eddy currents in the shunts themselves. Preferably, each shunt 36 has a radially-inwardly extending arm portion 40 which extends above and over the top of crucible 32. Arm 40 serves to couple at least a portion of the induction field from coil 34 to the top surface 42 of the melt (shown in phantom in FIG. 3), as indicated by the dashed lines representing flux lines of the induction field. As with the first-described embodiment, shunts 36 enable the induction field to bypass, and therefore not couple with, the side wall of crucible 32, resulting in greater coupling between the coil and the metal charge and, therefore, greater efficiency.

As with the first-described embodiment, furnace 30 can be tapped by tilting it to pour its contents into one or more casting molds or other receptacles. When pouring, the furnace may be tilted so that the melt is poured out between adjacent shunts, as indicated by the arrow 44 in FIG. 4. In that way, the melt can be poured without coming into contact with either coil 34 or shunts 36.

The present invention may be embodied in other specific forms without departing from the spirit or essential attributes thereof and, accordingly, reference should be made to the appended claims, rather than to the foregoing specification, as indicating the scope of the invention.

What is claimed is:

1. A coreless induction furnace comprising:

(a) a crucible for holding a quantity of metal to be heated by said furnace, said crucible having an open top for permitting access to a top surface of metal in said crucible, side walls and a closed bottom, and having means for permitting a cooling fluid to circulate therethrough;

(b) induction coil means operatively associated with said crucible for generating a time-varying magnetic induction field; and (c) coupling means for coupling at least a portion of the induction field to the center portion of the top surface of the metal to be heated, said coupling means extending above the top of said crucible.

2. A coreless induction furnace as in claim 1, wherein said coupling means comprises at least one turn of the induction coil means.

3. A coreless induction furnace as in claim 2, wherein a portion of said at least one turn is formed to define an opening for enabling molten in the crucible to be poured out through said opening without contacting said induction coil means.

4. A coreless induction furnace as in claim 1, wherein said coupling means comprises at least one magnetic shunt means operatively associated with said crucible and said induction coil means for coupling at least a portion of the induction field to the center portion of the top surface of the metal to be heated.

5. A coreless induction furnace as in claim 4, wherein said coupling means comprises a plurality of magnetic shunt means equally spaced around said induction coil means.

6. A coreless induction furnace comprising:

(a) a crucible for holding a quantity of metal to be heated by said furnace, said crucible having an open top for permitting access to a top surface of metal in said crucible, side walls and a closed bottom;

(b) induction coil means operatively associated with said crucible for generating a time-varying magnetic induction field; and (c) coupling means for coupling at least a portion of the induction field to the center portion of the top surface of the metal to be heated, said coupling means extending above the top of said crucible.

7. A coreless induction furnace as in claim 6, wherein said coupling means comprises at least one turn of the induction coil means.

8. A coreless induction furnace as in claim 7, wherein a portion of said at least one turn is formed to define an opening for enabling molten in the crucible to be poured out through said opening without contacting said induction coil means.

9. A coreless induction furnace as in claim 6, wherein said coupling means comprises at least one magnetic shunt means operatively associated with said crucible and said induction coil means for coupling at least a portion of the induction field to the center portion of the top surface of the metal to be heated.

10. A coreless induction furnace as in claim 9, wherein said coupling means comprises a plurality of magnetic shunt means equally spaced around said induction coil means.

11. A coreless induction furnace comprising:

(a) a crucible for holding a quantity of metal to be heated by said furnace, said crucible having an open top for permitting access to a top surface of metal in said crucible, side walls and a closed bottom, and having means for permitting a cooling fluid to circulate therethrough; and (b) induction coil means surrounding said crucible and extending from the bottom thereof to a preselected distance above the top thereof, for generating a time-varying magnetic induction field;

(c) said induction coil means having at least one coil turn above the top of said crucible for coupling at least a portion of the induction field to the center portion of the top surface of the metal to be heated.

12. A coreless induction furnace as in claim 11 wherein a portion of said at least one turn is formed to define an opening for enabling molten in the crucible to be poured out through said opening without contacting said induction coil means.

13. A coreless induction furnace comprising:

(a) a crucible for holding a quantity of metal to be heated by said furnace, said crucible having an open top for permitting access to a top surface of metal in said crucible, side walls and a closed bottom; and (b) induction coil means surrounding said crucible and extending from the bottom thereof to a preselected distance above the top thereof, for generating at time-varying magnetic induction field;

(c) said induction coil means having at least one coil turn above the top of said crucible for coupling at least a portion of the induction field to the center portion of the top surface of the metal to be heated.

14. A coreless induction furnace as in claim 13, wherein a portion of said at least one turn is formed to define an opening for enabling molten in the crucible to be poured out through said opening without contacting said induction coil means.

15. A coreless induction furnace comprising:

(a) a crucible for holding a quantity of metal to be heated by said furnace, said crucible having an open top for permitting access to a top surface of metal in said crucible, side walls and a closed bottom, and having means for permitting a cooling fluid to circulate therethrough;

(b) induction coil means surrounding said crucible for generating a time-varying magnetic induction field; and (c) magnetic shunt means operatively associated with said crucible and said induction coil means for coupling at least a portion of the induction field to the center portion of the top surface of the metal to be heated, a portion of said shunt means extending above the top of said crucible.

16. A coreless induction furnace as in claim 15, wherein said coupling means comprises a plurality of magnetic shunt means equally spaced around said induction coil means.

17. A coreless induction furnace comprising:

(a) a crucible for holding a quantity of metal to be heated by said furnace, said crucible having an open top for permitting access to a top surface of metal in said crucible, side walls and a closed bottom;

(b) induction coil means surrounding said crucible for generating a time-varying magnetic induction field; and (c) magnetic shunt means operatively associated with said crucible and said induction coil means for coupling at least a portion of the induction field to the center portion of the top surface of the metal to be heated, a portion of said shunt means extending above the top of said crucible.

18. A coreless induction furnace as in claim 17, wherein said coupling means comprises a plurality of magnetic shunt means equally spaced around said induction coil means.

19. In a cold crucible induction furnace, having an induction coil for generating a magnetic induction field surrounding a crucible containing metal to be heated in said furnace, said crucible having an open top for permitting access to a top surface of metal in said crucible, apparatus for increasing the efficiency of said furnace, comprising:

coupling means for coupling at least a portion of the induction field to the center portion of the top surface of the metal to be heated, said coupling means extending above the top of said crucible.

20. An induction coil for cold crucible induction heating, wherein metal to be inductively heated is contained in a cold crucible surrounded by said induction coil, said cold crucible having an axial length and said coil having an axial length longer than the axial length of the crucible and extending from the bottom of the crucible to a preselected distance past the top of said crucible, a portion of the coil above the top of said crucible being formed to define an opening between adjacent turns thereof for enabling molten metal in the crucible to be poured out through said opening without contacting the coil.

* * * * *